US005888306A

United States Patent [19]

Durand et al.

[11] Patent Number: 5,888,306

[45] Date of Patent: Mar. 30, 1999

[54] METHOD AND APPARATUS FOR MAKING A PURE SIMPLE SUGAR SOLUTION BY HYDROLYZING AT LEAST ONE COMPOUND SUGAR IN THE PRESENCE OF A SELECTIVE ADSORBENT

[75] Inventors: Germain-Robert Durand, Clapiers; Pierre Faugeras, Pont Saint Esprit; Françoise Laporte, Saint Laurent Des Arbres; Claude Moreau, Laverune; Marie-Claude Neau, Gardouch; Gabriel Roux, Meylan, all of France

[73] Assignee: Agrichimie, Le Robert, France

[21] Appl. No.: 849,396

[22] PCT Filed: Dec. 6, 1995

[86] PCT No.: PCT/FR95/01615

§ 371 Date: Jul. 10, 1997

§ 102(e) Date: Jul. 10, 1997

[87] PCT Pub. No.: WO96/17962

PCT Pub. Date: Jun. 13, 1996

[30] Foreign Application Priority Data

Dec. 7, 1994 [FR] France ..... 94 14961

[51] Int. Cl.[6] ..... C13K 1/00

[52] U.S. Cl. ..... 127/1; 127/40; 127/55

[58] Field of Search ..... 127/1, 40, 55

[56] References Cited

U.S. PATENT DOCUMENTS

| | | | |
|---|---|---|---|
| 118,523 | 8/1871 | Garton | 127/40 |
| 2,332,758 | 10/1943 | Schopmeyer et al. | 127/40 |
| 4,746,368 | 5/1988 | Frank et al. | 127/55 |
| 5,424,418 | 6/1995 | Duflot | 127/40 |

FOREIGN PATENT DOCUMENTS

| | | | |
|---|---|---|---|
| 837201 | 6/1976 | Belgium . | |
| 1526029 | 1/1968 | France . | |
| 1 136 676 | 9/1962 | Germany . | |
| 240253 | 10/1925 | United Kingdom | 127/55 |
| 1 516 435 | 7/1978 | United Kingdom . | |
| WO 92/07097 | 4/1992 | WIPO . | |

OTHER PUBLICATIONS

G. Bussiere et al., "Les sucres invertis", *Actualites Des Industries Alimentaires et Agro–Industrielles,* IAA (Jul./Aug. 1990), pp. 645–649.

D.H. Logsdail et al., "Pulsed Perforated–Plate Columns", *Handbook of Solvent Extraction,* (1983) no month avail., pp. 355–372.

*Primary Examiner*—David Brunsman
*Attorney, Agent, or Firm*—Young & Thompson

[57] ABSTRACT

A method and an apparatus for making a simple sugar solution from a liquid solution including at least one compound sugar by performing hydrolysis in the presence of a heterogeneous catalyst. The method comprises contacting the hydrolysis reaction medium with at least one microporous solid adsorbent compound selected for compatibility with the hydrolysis and . catalysis conditions and for selectively adsorbing by-products other than simple sugars under the hydrolysis reaction conditions. A pure, colourless, food-grade simple sugar solution is achieved.

37 Claims, 1 Drawing Sheet

METHOD AND APPARATUS FOR MAKING A PURE SIMPLE SUGAR SOLUTION BY HYDROLYZING AT LEAST ONE COMPOUND SUGAR IN THE PRESENCE OF A SELECTIVE ADSORBENT

FIELD OF THE INVENTION

The present invention relates to a process of and an installation for producing a liquid solution of simple sugars or oses from a liquid solution comprising at least one compound sugar or oside, in particular a holoside (polysaccharide or oligosaccharide) such as saccharose, inulin, starch, or the like.

BACKGROUND OF THE INVENTION

The reaction of the hydrolysis of compound sugars in liquid medium, generally an aqueous medium, in the presence of an acidic catalyst, is known. This reaction, sometimes known as "sugar inversion reaction" makes it possible normally to obtain an "invert sugar", that is to say a mixture of simple sugars, in particular of hexoses. In particular, if one starts from a solution of saccharose, one obtains an invert sugar formed of a mixture of fructose and glucose.

The article "Les sucres invertis" (Invert sugars) by BUSSIERE et al. in the IAA, July/August 1990, pages 645 to 649, already describes the hydrolysis reaction in the presence of ion exchange resins as heterogenous acidic catalysts. In order to avoid the formation of coloring substances, it has been believed up to now that it is preferable to operate at low temperature (on the order of 30° to 35° C.). In particular, in the case of the hexoses, it is convenient to avoid the formation of hydroxymethylfurfural (HMF) and of its derivatives or intermediates (polymers, humins, levulinic or formic acid, etc). Now, the actions resulting in the formation of HMF and its derivatives are also catalyzed in acid medium and favored by an elevated temperature, in particular, a temperature above 50° C. Furthermore, the use of an ion-exchange resin as acidic catalyst prohibits high temperatures.

It is to be noted in this connection that if it is desired actually to obtain a mixture of simple sugars, it is advisable to see to it that the reaction stops at the hydrolysis stage, without going beyond it to the degradation of the sugars and the formation of derivative products such as polyols, polymers, acids, HMF, or the like.

Up to now, it has therefore been preferred to limit the conversion rate of the compound sugar in order to avoid the formation of undesirable by-products. Thus, the known hydrolysis reactions do not make it possible, under economically profitable conditions, to obtain pure solutions of fully converted simple catalysts, that is to say without compound sugar or derivative products.

Furthermore, at the low temperatures used up to now with the ion-exchange resins, the conversion of the compound sugar is slight and the reaction requires considerable time, conventionally on the order of 12 to 48 hours.

Furthermore, the compound sugars have a high viscosity at these temperatures. It is now possible in actual use to employ a starting solution which is strongly concentrated in compound sugar, and a concentration step must be provided after the hydrolysis.

Similarly, the use of ion-exchange resins results in numerous drawbacks from an industrial standpoint, such as the formation of waste, difficulties in regeneration, and a high cost of production.

Thus, FR-A-1526 029 describes a process of decolorizing juice, syrup, molasses and even sugar mill waste permitting transforming totally or in part the saccharose comprising a step of decolorizing by ion exchange resins, with partial or total hydrolysis, a step of purification and decoloration by ion exchange resins and a step of concentration. The starting products being highly loaded with cations and anions, the resins are rapidly saturated, so that the process cannot find practical application in industry. Moreover, this process is in several steps, and requires a low inlet concentration (20 to 30 Brix).

For all of these reasons, the known processes, such as the one described in the aforementioned article, have known only limited industrial development and do not make it possible to produce invert sugars at low cost.

SUMMARY OF THE INVENTION

The present invention is directed at overcoming these drawbacks by proposing a process for the production of a solution of simple sugars under profitable conditions on an industrial scale.

Another object of the invention is a process and an installation which make it possible to obtain simple sugars in solution by hydrolysis with a yield, a reaction velocity, and a purity which are sufficiently high to contemplate their industrial production at a reasonable price and with limited industrial investments. In particular, the invention is directed at proposing a process which can be carried out in installations of small or medium size and capacity.

Still another object of the invention is to provide a process and an installation which are compatible with the ecological constraints for respect of the environment, in particular without the production of waste products.

The invention is also directed at proposing a method of and an installation for producing simple sugars in a single step, continuously, without extraction solvent, by hydrolysis of a solution of compound sugar or sugars.

Still another object of the invention is to propose a process and an installation for the production of a pure, and particularly colorless, solution of simple sugars by hydrolysis. In particular, the invention is directed at proposing a single-step continuous process for the production of an aqueous solution of simple sugars of agro-foodstuff quality, which is, in particular, colorless and, more particularly, comprises less than 1% of hydrolysis residues other then simple sugars.

The invention is also directed at proposing a process for the production of a solution of simple sugars by hydrolysis of a solution of simple sugars by hydrolysis of a solution of compound sugar or sugars with a conversion rate greater than 95%, carried out with a reaction time of less than 4 hours.

The invention is also directed at proposing a process and an installation for the production of an aqueous solution of simple sugars by hydrolysis at a temperature above 50° C. and, in particular, about 85° C., of a strongly concentrated solution of compound sugar or sugars the proportion by weight of solids of which is, in particular, greater than 60%.

The invention is directed more particularly at proposing a process and an installation for the industrial production of a pure, colorless solution of oses, in particular glucose and fructose, by hydrolysis of a solution of polysaccharide or polysaccharides and/or oligosaccharide or oligosaccharides, and particularly starch or saccharose.

In order to do this, the invention has as its object a process for the production of a solution of simple sugars from a liquid solution comprising at least one compound sugar, by hydrolysis in the presence of a heterogenous catalyst system, that is to say one or more solid catalysts, this process being characterized essentially by the fact that the hydrolysis reaction medium is placed in contact with at least one microporous solid adsorbent compound selected so as to be compatible with the hydrolysis and catalysis conditions and so as to selectively adsorb the residues or by-products other than the simple sugars under the reaction conditions of the hydrolysis. In accordance with the invention, an adsorbent compound is selected so as not to adsorb the initial compound sugar or sugars.

A solid microporous adsorbent compound usable in a process according to the invention is a mineral compound of natural or synthetic origin formed by three-dimensional chains of tetrahedra $TO_4$ with T representing at least two different elements of the periodic table such as Si, Al, B, Fe, Ga, Ge, etc . . . In this chain, the oxygen atoms of the tetrahedra $TO_4$ are in common with the neighboring tetrahedra.

A solid microporous adsorbent compound is a solid having pores of dimensions generally less than about $10^{-9}$ m. In this connection, it is to be noted that a solid microporous absorbent compound is distinguished from the macroporous solids (whose pores have dimensions generally greater than $10^{-8}$ m) such as resins, and mesoporous solids (whose pores have dimensions generally comprised between $2.10^{-9}$ m and $10^{-8}$ m).

In accordance with the invention, the catalysis system and the solid microporous adsorbent compound or compounds are selected in such a manner that:

the hydrolysis reaction takes place with a conversion of more than 95% of the compound sugar or sugars and with a selectivity for simple sugars of more than 80%;

the solid microporous adsorbent compound or compounds are capable of adsorbing the entire quantity of residues or by-products, during the time of the reaction.

As the solid microporous adsorbent compound or compound adsorb the by-products, it is possible to carry out the reaction at high temperature with a high conversion rate and a high initial concentration of sugar, particularly higher than 65 Brix, for example about 68 Brix. the solution obtained is furthermore a syrup, of great purity, of simple sugars and, in particular, it is colorless.

Furthermore, the dwell time is short and the installation for the carrying out of the process is simple and takes up little space.

In accordance with another feature of the invention, a tectosilicate of a clay in proton form is used as acidic heterogenous catalyst for the hydrolysis reaction. It is found, in fact, that such a catalyst makes it possible to obtain a conversion of the compound sugar of more than 99% within a time of less than 2 hours, with an optimal selectivity for simple sugars of more than 80%.

The tectosilicates are microporous compounds characterized by a structure comprising:

a three-dimensional skeleton formed by chains of tetrahedra $TO_4$, $SiO_4$, T representing a classification element such as Al, B, Ga, Ge, . . . and, a monodimensional, bidimensional, or tridimensional network of channels and cavities of molecular dimensions containing if desired compensation cations, of water or other molecules or salts.

In particular, in accordance with the invention there is preferably used as acidic catalyst a zeolite (aluminosilicate) in proton form, such as a faujasite Y in H form having an Si:Al ratio of between 2 and 100, and in particular between 10 and 20, and preferably about 15.

The heterogenous catalysis system and the operating conditions, in particular concentrations and temperature, are selected in such a manner as, on the one hand, to avoid the formation of products other than the simple sugars and, on the other hand, to avoid the degradation of these simple sugars and, in particular, to minimize or even avoid the formation of HMF, in the case in particular of hexoses, fructose or polyfructans and coloring substances. The heterogenous catalyst can itself play a role as selective adsorbent. Nevertheless the catalyst is selected in such a manner that it does not adsorb the sugars and, in particular, the simple sugars.

The present invention relates in particular to a process for the production of a solution comprising at least one hexose from a solution comprising at least one holoside, such as saccharose, which is hydrolyzable to at least one hexose, such as fructose of glucose. In accordance with the invention, as solid microporous adsorbent compound there is used a molecular sieve the porosity of which, that is to say the size of the pores and channels, is defined so as selectively to adsorb the by-products other than the simple sugars and the initial compound sugar or sugars, and in particular to adsorb the molecules of colored by-products and/or the molecules of HMF.

In accordance with the invention, a tectosilicate or a clay, in particular an adsorbing zeolite, or alumina is used as solid microporous adsorbent compound.

In the first variant of the invention, a solid microporous compound which at the same time serves as catalyst or catalyst support for the hydrolysis is advantageously employed. In particular, in this variant, in accordance with the invention, the reaction medium is placed in contact with an adsorbent zeolite, particularly in proton form or in partially calcined ammonium form, which serves both as heterogenous acidic catalyst and as molecule sieve adsorbing the undesirable products, such as the coloring substances and the HMF. This first variant has the advantage of providing a process in which one obtains a solution of simple sugars in the short time with the use of a single solid compound.

In a second variant of the invention, at least one solid microporous adsorbent compound other than the heterogenous catalyst is advantageously used. For example, a zeolite in proton form is used as acidic heterogenous catalyst while, as solid microporous adsorbent compound, there is used an adsorbent zeolite forming a molecular sieve the acidity of which is slight but nevertheless compatible with the acidic catalyst. This second variant affords the advantage of permitting a separate control of the catalyst of the catalyst of the hydrolysis and of the adsorption of the coloring substances or HMF or other undesirable by-products.

In accordance with another feature of the invention, the hydrolysis reaction is carried out continuously in multicontact reactors, in particular a pulsed reaction/extraction column.

In accordance with the invention, at least one solid microporous adsorbent compound, preferably preformed, in particular in extruded form, is caused to circulate in countercurrent to the reaction medium. The solid microporous adsorbent compound can be regenerated continuously, in particular by calcining after its passage through the reactor, and then recycled to the inlet of the reactor. A heterogenous catalyst in powder form which is caused to circulate in dispersion in co-current with the reaction medium in the reaction medium in the reactor can furthermore advantageously be employed.

In an advantageous variant, the heterogenous catalyst and the solid microporous adsorbent compound or compounds are mixed, and this mixture of solids is circulated in countercurrent to the reaction mixture.

In accordance with the invention, a strongly concentrated starting solution of compound sugars is used, the proportion by weight of the solids in compound sugars being possibly greater than 60% (syrup of more than 60 brix), and in particular on the order of 65% to 70% (syrup of 65 brix to 70 brix).

In accordance with the invention, the heterogenous catalyst is used in an amount of 1% to 20%, and in particular on the order of 7.5%, by weight of the solids of the starting solution. The solid microporous adsorbent compound is advantageously used in an amount of 2% to 40%, and in particular about 15%, by weight of the solids of the starting solution. Thus, in accordance with the invention, when the solid microporous adsorbent compound is different from the heterogenous compound one uses a weight of adsorbent compound which is greater than the weight of the heterogenous catalyst, particularly about twice the weight of the heterogenous catalyst.

It is to be noted that one or more solid microporous adsorbent compounds can be used simultaneously, each of them having properties of selective adsorption which are so defined as to adsorb a by-product or family of by-products. One can, for instance, use a solid microporous adsorbent compound capable of adsorbing the HMF and another solid microporous adsorbent compound capable of adsorbing the coloring substances and/or polymers. The ability of a molecular sieve to selectively adsorb this or that product depends on its three-dimensional structure, on the size of the pores, cages and channels which it contains, and on the physical-chemical affinities. It is known in practice how to define, produce or select a solid microporous absorbent compound (a molecular sieve) as a function of the products which are to be selectively adsorbed.

Also, one can simultaneously use one or more heterogenous catalysts which produce different effects. In particular, one can use catalysts which have different speeds of exhaustion and/or catalysts which favor subsequent reactions of the hydrolysis, for instance the isomerization of glucose into fructose.

In accordance with the invention, the reaction is carried out at a temperature of between 60° C. and 120° C., and in particular on the order of 80° C. to 85° C., and one uses at least one catalyst and at least one solid microporous adsorbent compound which are compatible with that temperature. It is to be noted in particular that the tectosilicates perfectly withstand this temperature range.

In practice, it is found that by means of a process in accordance with the invention, one can obtain a total conversion of the compound sugar or sugars into simple sugars in less than 2 hours. Thus, in accordance with the invention, the time of stay of the reaction medium in the reactor is less than 2 hours and, in particular, between half an hour and one hour.

In accordance with the invention, the starting solution contains at least one oside selected from the group formed of the polysaccharides such as inulin or starch, and the oligosaccharides such as saccharose, maltose, cellobiose or lactose.

The invention relates in particular to a process of producing a colorless solution of oses from starch and/or saccharose in liquid medium by hydrolysis in the presence of an acidic heterogenous catalyst.

In accordance with the invention, the starting solution, and thus the reaction medium and the final solution, is advantageously an aqueous solution.

The invention also relates to an installation for practicing a process according to the invention. An installation according to the invention is characterized in that it comprises at least one reactor and means for placing a reaction medium for the hydrolysis of a liquid solution comprising at least one compound sugar, in contact with a heterogeneous hydrolysis catalyst system and at least one solid microporous absorbent compound.

According to the invention, the installation is characterized in that it comprises at least one pulsed column, and means to cause to circulate simultaneously continuously in the pulsed column the liquid hydrolysis reaction medium, the heterogeneous hydrolysis catalyst and the solid microporous absorbent compound or compounds.

Preferably, and according to the invention, the installation is characterized in that it comprises means to cause to circulate the solid microporous absorbent compound or compounds countercurrent to the liquid hydrolysis reaction medium.

It is to be noted that in a process and an installation according to the invention, the pulsed column serves not only solely as a separator, but also and above all as a continuous multicontact reactor. There is thus carried out simultaneously in the pulsed column, and in a single stage, the continuous hydrolysis and selective extraction reaction of the by-products and undesirable impurities (colorants, . . . ). Moreover, thanks to the invention, the starting sugar solution can be strongly concentrated, the reaction time is reduced and the use of toxic or pollutant solvents and the discharge of pollutant effluents are avoided.

It is to be noted in this connection that the combined characteristics of the invention permit obtaining this result by the fact that it is possible to operate with concentrated syrups (Brix greater than 65) at high temperature, with a short reaction time, the reaction conditions strongly shifting the equilibrium.

The invention also relates to a process and an installation for the production of a solution of simple sugars comprising, in combination, all or part of the characteristics mentioned above or below.

BRIEF DESCRIPTION OF THE DRAWINGS

Other characteristics and advantages of the invention will become evident from the following description, read with reference to the accompanying drawings, in which.

DETAILED DESCRIPTION OF THE INVENTION

Figure 1:
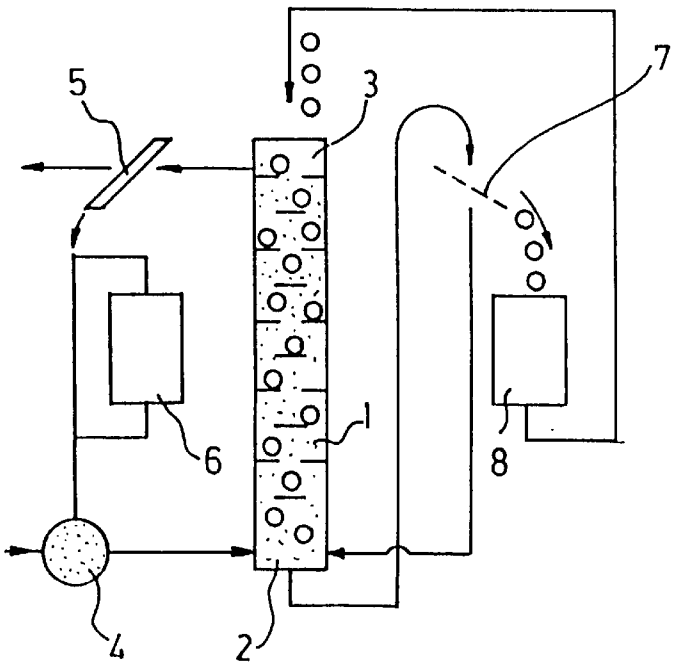
FIG. 1 is a diagram illustration an installation for the carrying out of a process in accordance with a first variant of the invention.

In FIG. 1, the installation for the carrying out of the process of the invention is formed essentially of a pulsed column 1 at the lower part 2 of which there is introduced a concentrated solution of compound sugar, in particular starch or saccharose. Reaction products, namely the solution of simple sugars, particularly glucose and fructose, is extracted from the upper part 3 of the pulsed column 1.

In order to effect the hydrolysis in this pulsed column, a heterogenous catalyst in powder form is mixed within a mixer 4 with the solution of compound sugars before introducing it into the column 1. This heterogenous catalyst is an acidic catalyst, for instance a zeolite Y(H) in powdered form. This catalyst, dispersed in the solution of compound sugars which circulates from the bottom to the top in the column 1, is removed with the liquid phase, in which it is dispersed, at the upper part 3. A filter 5 makes it possible to separate the catalyst from the aqueous solution of simple sugars at the outlet of the column 1. The catalyst recovered on the filter 5 is recycled into the mixer 4, either directly, if it is still active, or after a regeneration step, for instance by passing into a calcining furnace 6 of any other suitable regenerating device, depending on the nature of the catalyst.

Furthermore, one or more solid microporous adsorbent compounds are introduced continuously in the upper part 3 of the column 1, they circulating by gravity downward in the column 1 and being recovered at the lower part 2. The adsorbent compound is, for instance, an extruded zeolite Y(H) shaped in granules, bars, cylinders, balls or the like, forming an adsorbent molecular sieve. The solid microporous adsorbent compound must be compatible with the acidic catalyst used for the hydrolysis. In particular, it must not neutralize the acidity of the catalyst. The pieces of solid microporous adsorbent compound which are recovered in the lower part 2 are transported by a device forming a hydraulic lift up to a screen 7 which makes it possible to isolate the granules and/or cylinders, which are then introduced into a calcining furnace 8 in which the adsorbent compound is regenerated, the products trapped in the pores of this compound being burned. At the outlet of the furnace 8, the adsorbent compound can be recycled and again introduced continuously in the upper part 2 of the column 1.

Pulsed columns are known vertical multicontact devices in which can be generated pulses (compare for example the document "Pulsed Perforated-Plate Columns", D. H. Logsdail, M. J. Slaten, Handbook of Solvent Extraction, Teh C. Lo Malcolm H. I. Baird, Carl Hanson, Krieiger Publishing Company, Malabar, Fla., 1991, 11-2, pp 335–372, incorporated by reference into the present disclosure).

The packing (baskets and crowns, or disks and crowns) as well as the amplitude and frequency of the pulses are determined to obtain continuous circulation upwardly of the reaction medium and the continuous circulation of the solid catalyst or catalysts and of the solid microporous absorbent compound or compounds.

It can be noted that such an installation is very simple in its principle and use. The temperature within the pulsed column may be maintained at the reaction temperature, in particular between 80° C. and 85° C. The proportions by weight of the starting solution of the compound sugar or sugars, acidic catalyst and solid microporous adsorbent compound or compounds as indicated above are adjusted, regulating the rates of flow of the different components and the speed of circulation in the pulsed column 1, in such a manner that the desired conversion of the compound sugar or sugars is obtained at the upper outlet 3 of the pulsed column 1. A total conversion of the compound sugar can thus be obtained, despite a short time of stay of the reaction medium in the pulsed column 1, in particular a time of less than two hours.

Figure 2:
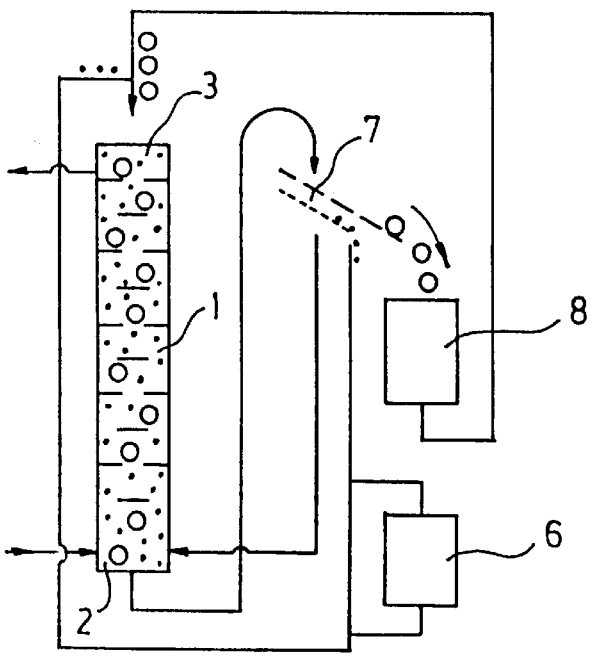
FIG. 2 is a diagram illustrating an installation for the carrying out of a process in accordance with a second variant of the invention.

The variant of FIG. 2 differs from that of FIG. 1 solely by the fact that the heterogenous acidic catalyst is no longer introduced in co-current with the starting solution of the compound sugar or sugars but circulates in countercurrent with the solid microporous adsorbent compound or compounds. The acidic catalyst is then no longer in powdered form but in the form of granules and/or balls and/or cylinders in order to be able to circulate by gravity through the pulsed column 1 from the upper part 3 to the lower part 2. The heterogenous acidic catalyst is recovered with the adsorbent compound at the lower part 2 of the column 1 and transported by hydraulic lift towards the screen 7 which, in this case, is a double screen making it possible to separate the balls and the granules and/or cylinders of acidic catalyst from the granules and/or cylinders of acidic catalyst from the granules and/or cylinders of solid microporous adsorbent compound. In order to do this, the particle size of the acidic catalyst will be different from that of the solid microporous adsorbent compound. At the outlet from the screen 7, the acidic catalyst is either directly introduced again into the upper part 3 of the column 1 if it is still active or it is regenerated, for instance by a calcining furnace 6 or other regenerating device, before being recycled into the column 1. The solid microporous adsorbent compound follows the same circuit as that described with reference to FIG. 1. It is to be noted that the heterogenous acidic catalyst may also serve as selective adsorbent of one or more residues or reaction by-products. The concentrated solution of the compound sugar or sugars is introduced directly into the lower part 2 and flows upward in the pulsed column 1. At the upper part 3, the solution of simple sugars is recovered directly. In this variant, it is to be noted that the operations of FIG. 1 of mixing in the mixer 4 and filtering in the filter 5 are eliminated.

Figure 3:
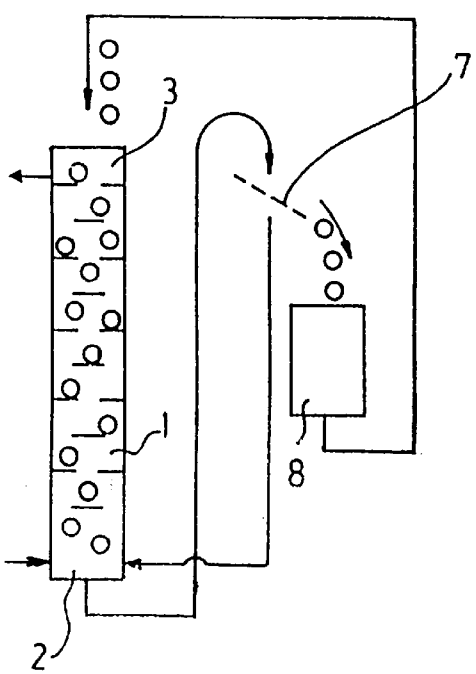
FIG. 3 is a diagram illustrating an installation for the carrying out of a process in accordance with a third variant of the invention.

FIG. 3 illustrates a variant similar to that of FIG. 1 in which the solid microporous adsorbent compound and the acidic catalyst are formed of one and the same adsorbent microporous solid in proton form. One can, for instance, use an adsorbent zeolite Y in extruded proton form. The variant of FIG. 3 differs from that of FIG. 1 by the fact that the mixer 4, the filter 5, and the regeneration step 6 are eliminated. In this variant, a single solid compound circulates within the pulsed column 1.

EXAMPLE 1

A saccharose syrup is prepared comprising 300 g of saccharose, 167.5 g of water, and 22.5 g of powdered zeolite Y in proton form, having an Si:Al ratio of 15. In order to prepare this syrup, one-fifth of the water is wetted with the zeolite powder, whereupon the saccharose is mixed with the remaining four-fifths of the water and with the wetted zeolite.

This syrup is introduced into an agitated mixer, heated to 82° C. The syrup is maintained in this mixer for 25 minutes, whereupon the solution is rapidly cooled to 25° C.

It is found that the solution obtained is a syrup of glucose and fructose with a conversion rate of the saccharose of 95%. The solution is clear and transparent, but of a yellow color.

Liquid chromatographic analysis under pressure of the HPLC type makes it possible to note the presence of 600 ppm of HMF. This presence is explained by the use of too small an amount of zeolite, the adsorbent power of which is not sufficient.

EXAMPLE 2

A syrup is prepared in the manner described in Example 1 and this syrup is maintained in the mixer at 82° C. for a period of 40 minutes.

It is noted that the final solution is a solution of glucose and fructose, the conversion rate of the saccharose being 100%. HPLC chromatographic analysis shows the presence of 1200 ppm of HMF in the solution. The solution of glucose and fructose is clear and transparent, but of a yellow color.

EXAMPLE 3

A saccharose syrup is prepared in the manner described in Example 1, using 22.5 g of powdered zeolite Y in proton form. There are then added into the mixer, heated to 82° C., 45 g of adsorbent zeolite Y in partially calcined ammonium form ($NH_4$), extruded, shaped into cylinders, the Si:Al ratio of which is 15. This zeolite comprises a binder and is then less acid and less active than the previous one.

After a stay of 25 minutes in the mixer, it is cooled suddenly to 25° C. and the final solution is analyzed. It is found that the conversion rate is 95%. The final solution is a syrup of glucose and fructose which is perfectly clear, transparent and colorless, and which remains stable for several months. HPLC liquid chromatography reveals the presence of 60 ppm of HMF, corresponding to food purity. On the other hand, it is found that the extruded adsorbent zeolite is beige-brown in color.

Simultaneously with this manipulation, the activity of the adsorbent zeolite as catalyst of the hydrolysis is studied by a separate manipulation. For this purpose, this adsorbent zeolite is placed in a saccharose syrup formed of 300 g of saccharose and 167.5 g of water. It is found that with the 45 g of adsorbent zeolite and in the absence of acidic powdered zeolite, the conversion rate of the saccharose into simple sugars is only 60% after a time of stay of one hour. The adsorbent zeolite plays only a slight role as catalyst in the reaction.

EXAMPLE 4

The same saccharose syrup as in Example 3 prepared, using 22.5 g of powdered zeolite and 45 g of adsorbent zeolite. One waits 40 minutes instead of the 25 minutes of Example 3 and then cools it suddenly to 25° C. It is found that the resultant syrup of fructose and glucose is perfectly clear, transparent and colorless, and is stable for several months. The rate of conversion of the saccharose is 100%. HPLC chromatography reveals the presence of 100 to 120 ppm of HMF. The adsorbent zeolite is of beige-brown color.

Examples 3 and 4 show that with a time of stay of between 25 and 40 minutes, there is obtained, in a batch reactor, a conversion of 95 to 100% of the saccharose into glucose and fructose of food purity. The reactions of the above examples can be carried out continuously in the installations shown in the figures with dwell times which are even lower.

EXAMPLE 5

There is prepared an aqueous syrup of starch comprising 500 g/l of starch, and more than 20 g/l of zeolite Y in protonic form whose ratio Si/Al is 15 (Faujasite) as indicated in Example 1.

The reaction temperature is 150° C. and the reaction time is 60 minutes.

It is noted that the final solution is a solution of simple sugars (the conversion rate into simple sugar is 100%) of which more than 85% is glucose and less than 15% maltose. The maltose is a diholoside comprised of two units of D glucose. It is therefore a precursor of glucose which can be recycled in the starting hydrolysis solution.

The invention is also applicable to the hydrolysis of other compound sugars into simple sugars.

We claim:

1. A process for the production of a solution of simple sugars from a liquid solution comprising at least one compound sugar, by hydrolysis in the presence of a heterogenous catalysis system, characterized by the fact that the reaction medium is placed in contact with at least one microporous solid adsorbent compound selected so as to be compatible with the conditions of hydrolysis and catalysis and so as to selectively adsorb the residues or by-products other than the simple sugars under the reaction conditions of the hydrolysis.

2. A process according to claim 1 for the production of a solution comprising at least one hexose from a solution comprising at least hydrolyzable holoside in at least one hexose, characterized by the fact that as solid microporous adsorbent compound there is used a molecular sieve capable of adsorbing the molecules of hydroxymethylfurfural and/or colored by-products.

3. A process according to claim 1, characterized by the fact that the catalysis system and the solid microporous adsorbent compound or compounds are selected in such a manner that:

the hydrolysis reaction takes place with a conversion greater than 99% of the compound sugar or sugars and with a selectivity for simple sugars of more than 80%;

the solid microporous adsorbent compound or compounds are capable of adsorbing the entire quantity of residues or by-products during the time of the reaction.

4. A process according to claim 1, characterized by the fact that the solid microporous adsorbent compound used is a tectosilicate or a clay.

5. A process according to claim 4, characterized by the fact that the solid microporous adsorbent compound is an adsorbent zeolite.

6. A process according to claim 5, characterized by the fact that the adsorbent zeolite is in ammonium form.

7. A process according to claim 1, characterized by the fact that a catalyst which also acts as solid microporous adsorbent compound is used.

8. A process according to claim 1, characterized by the fact that a microporous solid adsorbent compound different from the heterogenous catalyst is used.

9. A process according to claim 1, characterized in that there is used a weight of solid microporous adsorbent compound greater than the weight of heterogeneous catalyst.

10. A process according to claim 9 wherein the solid microporous adsorbent compound is used in the amount of about twice the weight of the heterogeneous catalyst.

11. A process according to claim 1, characterized by the fact that the heterogenous catalyst and the operating conditions are so selected as to minimize the formation of hydroxymethylfurfural and/or of coloring by-products.

12. A process according to claim 1, characterized by the fact that a tectosilicate or a clay in proton form is used as heterogenous catalyst.

13. A process according to claim 12, characterized by the fact that a zeolite in proton form with an Si:Al ratio of between 2 and 100 is used as acidic heterogenous catalyst.

14. A process according to claim 12, characterized by the fact that a faujasite Y in H form is used.

15. A process according to one of claim 1, characterized by the fact that a zeolite in proton form having an Si:Al ratio of between 10 and 20.

16. A process according to claim 15 wherein the zeolite has an Si:Al ration of about 15.

17. A process according to claim 1, characterized by the fact that the hydrolysis is carried out continuously in a multi-contact reactor and that the solid microporous adsorbent compound or compounds are circulated in countercurrent to the reaction medium.

18. A process according to claim 17, characterized by the fact that a preformed solid compound circulating in countercurrent is used as solid microporous adsorbent compound.

19. A process according to claim 18 wherein the preformed solid compound is in extruded form.

20. A process according to claim 17, characterized by the fact that the solid microporous adsorbent compound is regenerated after its passage through the reactor and by the fact that it is recycled to the inlet of the reactor.

21. A process according to claim 17, characterized by the fact that a powdered heterogenous catalyst is used and that this catalyst is circulated as a dispersion in co-current with the reaction medium.

22. A process according to claim 17 wherein the hydrolysis is carried out in a pulsed reaction/extraction column.

23. A process according to claim 1, characterized by the fact that a heterogenous catalyst and the adsorbent compound or compounds are mixed, and that the mixture is circulated in countercurrent to the reaction medium.

24. A process according to claim 1, characterized by the fact that a starting solution is used in which the weight proportion of the solids in the compound sugar or sugars is greater than 60%.

25. A process according to claim 24 wherein the weight proportion of the solids is 65% to 70%.

26. A process according to claim 1, characterized by the fact that the heterogenous catalyst is used in an amount of 1% to 20% by weight of the solids content of the starting solution.

27. A process according to claim 26 wherein the heterogeneous catalyst is used in an amount of about 7.5%.

28. A process according to claim 1, characterized by the fact that the adsorbent compound is used in an amount of 2% to 40% by weight of the solids content of the starting solution.

29. A process according to claim 28 wherein the adsorbent compound is used in an amount of about 15%.

30. A process according to claim 1, characterized by the fact that the reaction is carried out at a temperature of between 60° C. and 120° C. and that solid microporous adsorbent compounds and catalysts compatible with this temperature are used.

31. A process according to claim 30 wherein the reaction carried out at a temperature of about 80° C. to 85° C.

32. A process according to claim 1, characterized by the fact that the sojourn time of the reaction mixture in the reactor is less than 2 hours.

33. A process according to claim 32 wherein the sojourn time is between 0.5 and 1 hour.

34. A process according to claim 1, characterized by the fact that the starting solution comprises at least one oside selected from the group consisting of inulin, starch, saccharose, maltose, cellobiose and lactose.

35. An installation for practicing a process according to claim 1, characterized in that it comprises at least one reactor (1), and means to place a hydrolysis reaction medium of a liquid solution comprising at least one compound sugar in contact with a heterogeneous hydrolysis catalyst system and at least one solid microporous absorbent compound.

36. An installation according to claim 35, characterized in that it comprises at least one pulsed column (1) and means to cause to circulate simultaneously continuously in the pulsed column (1) the liquid hydrolysis reaction medium, the heterogeneous hydrolysis catalyst system and the solid microporous absorbent compound or compounds.

37. An installation according to claim 36, characterized in that it comprises means to cause to circulate the solid microporous absorbent compound or compounds countercurrent to the liquid hydrolysis reaction medium.

* * * * *